US005299497A

United States Patent [19]

Dias

[11] Patent Number: 5,299,497

[45] Date of Patent: Apr. 5, 1994

[54] HANDLE STRUCTURE FOR A STAMPING DEVICE

[75] Inventor: Ken Dias, Concord, Calif.

[73] Assignee: GB Products International Corp., Concord, Calif.

[21] Appl. No.: 9,033

[22] Filed: Jan. 26, 1993

Related U.S. Application Data

[63] Continuation-in-part of Ser. No. 881,225, May 11, 1992, abandoned.

[51] Int. Cl.[5] ..... B41K 1/46

[52] U.S. Cl. ..... 101/405; 16/110 R; 16/DIG. 12; 101/327

[58] Field of Search ..... 74/543; 16/110 R, DIG. 12, 16/DIG. 19; 101/405, 406, 327, 333; D18/14, 15, 18

[56] References Cited

U.S. PATENT DOCUMENTS

| | | | |
|---|---|---|---|
| 1,196,512 | 8/1916 | Brookman | 101/405 |
| 2,076,836 | 4/1937 | Goldblatt | 16/110 R |
| 2,177,064 | 10/1939 | Harsted | 16/110 R X |
| 2,421,339 | 5/1947 | Leger | 16/116 X |
| 2,801,583 | 8/1957 | Loushay | 101/405 X |
| 3,189,069 | 6/1965 | Stowell | 74/543 X |
| 3,227,082 | 1/1966 | Lynch | 101/405 |
| 4,037,850 | 7/1977 | Haberlin | 74/543 X |
| 4,091,497 | 5/1978 | Bade | 16/110 R |
| 4,641,857 | 2/1987 | Gailiunas | 16/DIG. 12 X |
| 4,690,053 | 9/1987 | Munyon et al. | 101/405 X |
| 4,885,818 | 12/1989 | Arterbury | 16/116 X |
| 4,926,521 | 5/1990 | Gagnepain | 16/DIG. 12 X |
| 4,934,024 | 6/1990 | Sexton, I | 16/DIG. 12 X |

FOREIGN PATENT DOCUMENTS

| | | | |
|---|---|---|---|
| 1112170 | 3/1956 | France | 16/110 R |

*Primary Examiner*—Edgar S. Burr
*Assistant Examiner*—Christopher A. Bennett

[57] ABSTRACT

A handle structure for a stamping implement, such as a marking device, utilizing a base member having an outer surface which is easily gripable. The outer surface is capable of being contacted by least one of fingers II–V of the hand. A flange is linked to the base member and includes a ramped surface which is intended for contacting the thumb, finger I, of the hand. The base member and linked flange are connected to the stamping implement for use.

2 Claims, 2 Drawing Sheets

HANDLE STRUCTURE FOR A STAMPING DEVICE

CROSS-REFERENCES TO RELATED APPLICATIONS

The present application is a continuation-in-part of application Ser. No: 07/881,225, filed 11 May 1992, now abandoned.

BACKGROUND OF THE INVENTION

The present invention relates to a novel handle structure for a marking or stamping implement.

Marking devices such as hand held stamps normally require repetitive use in a downward motion. Conventional marking devices include a handle structure which is gripped by the user's hand such that the thumb wraps around a handle and lies next to the non-thumb fingers of the hand. Unfortunately repetitive use of such a stamping device causes serious medical disabilities such as "trigger finger", "carpel tunnel syndrome" and "palm tissue deterioration", to name a few. These medical conditions may take the form of a complete disability in the user of the stamping implement, and requiring medical treatment prior to continuing work. However, use of the same stamping implement, results in the same medical disabilities.

In the past, physical therapy has been prescribed for suffers of such medical conditions as "carpel tunnel syndrome". Such physical therapy has met with mixed results.

A handle structure which greatly decreases or eliminates medical disabilities caused by repetitive use of an implement, such as a stamping or marking device, would be a great advance in the medical field.

SUMMARY OF THE INVENTION

In accordance with the present invention a novel and useful handle structure for a stamping implement is herein provided.

The handle structure of the present invention includes a base member having an outer surface possessing a gripping element such as a group of spaced knurls. The gripping element is intended for contact with the non-thumb fingers of the hand of the user, i.e.: fingers II, III, and IV. The base member may be substantially surrounded by a cover formed of soft material.

Connected to the base member is a flange. The flange possesses a ramped surface which lies apart from an opposition to the gripping element. The flange and base members are connected to an implement such as an inked stamping device. The ramped surface lies a further distance from the implement than does the gripping element. The ramp surface of the flange is capable of being contacted by the thumb of the user and may be formed of harder material than the soft base cover. In certain cases, the cover may extend over the flange. A protuberance may be formed at the base of the ramp and is intended for contacting the distal or outer joint of the thumb. The flange may include an aperture through the same to permit the handle structure of the present invention to be placed on a hook or like hanging element.

Means is also provided in the present invention for connecting the base member and linked flange to the implement. In this regard, base member includes a core which may be formed of a material which is more rigid than the soft outer surface of the cover surrounding the base member. In any case, the outer surface of the base member substantially surrounds the core. A cavity is formed in the core such that a shaft which forms part of the implement is received within the cavity and the stamping implement is attached to the base member by a frame.

It may be apparent that a novel and useful handle structure implement has been described.

It is therefore an object of the present invention to provide a handle structure for an implement which permits usage of such implement during repetitive processes such as stamping, without inducing medical disorders in the user.

A further object of the present invention is to provide a handle for a stamping implement which prevents lateral movement of the palm of a hand when in use.

Another object of the present invention is to provide a handle for a stamping implement which is useable in a sitting or standing position without inducing a medical disorder in the user.

It is another object of the present invention to provide a easily grippable handle structure for a implement which is employed with a variety of mechanically manipulated implements such as stampers, markers, erasers, and the like.

Yet another object of the present invention is to provide a handle structure for a stamping implement which may be retrofitted to existing implements quickly and inexpensively.

The invention possesses other objects and advantages especially as concerns particular characteristics and features thereof which will become apparent as the specification continues.

For a better understanding of the invention reference is made to the following detailed description of the preferred embodiments thereof which should be referenced to the herein before described drawings.

DESCRIPTION OF THE PREFERRED EMBODIMENTS

Various aspects of the present invention will evolve in the following detailed descriptions of the preferred embodiment thereof, which, should be taken with the prior described drawings.

Figure 1:
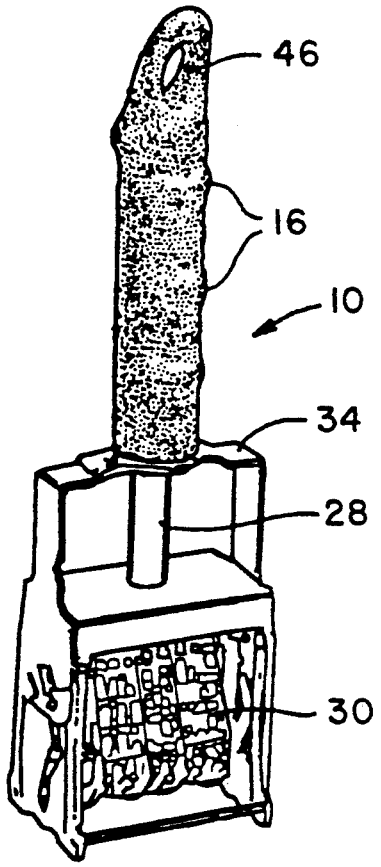
FIG. 1 is a front, top, perspective view of a self inking stamping device fitting with the handle structure of the present invention.
Figure 2:
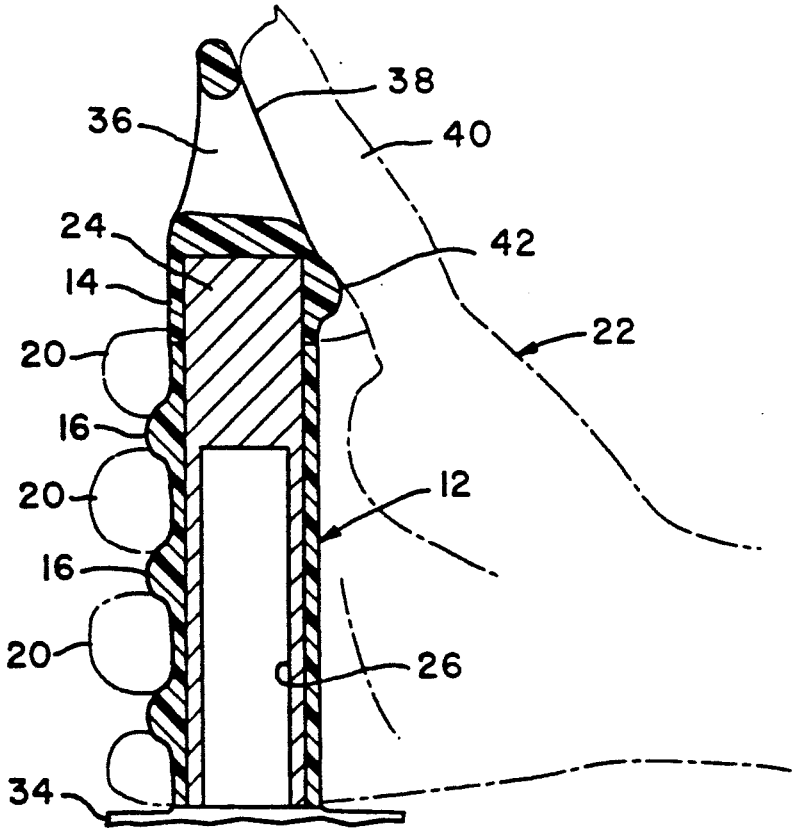
FIG. 2 is a sectional view of the handle structure of the present invention depicting a human hand grasping the handle structure.

The handle structure as a whole is depicted in FIG. 1 by reference character 10, includes as one of its elements a fingers-palm engaging portion 12 having an outer surface 14, best shown in FIG. 2. Gripping element 16 lies on outer surface 14 of fingers-palm engaging portion 12 and may take the form of plurality of knurls 18 as depicted in FIGS. 1 and 2. However, gripping element 16 may also take the form of a roughened surface, a series of ridges, a combination of crossed hatched scores, and the like. In any case, gripping elements 16 is intended for contact with at least one of the fingers 20 of a hand 22.

Fingers-palm engaging portion 12 also includes a core 24 possessing a cavity 26. Post 28 connects to implement 30, which is depicted as a selfinking stamping device. Means 32 for connecting base member 12 to implement 30 would include a frame 34 as well as post 28 which is fixed to implement 30. It should be noted that post 28 extends through frame 34 of implement 30, FIG. 1.

Handle structure 10 also encompasses a thumb engaging portion or flange 36 having a ramped surface 38 intended for contacting the thumb 40 of hand 22. Ramp surface 38 terminates in a protuberance 42 which contacts and generally supports the last joint of thumb 40, FIG. 2. Aperture 46 passes through flange 36 to permit handle structure 10 to be used in conjunction with the hook or other hanging element. As depicted in the drawings, flange 36 is formed separately from base member 12, but may also be formed integrally with base member 12.

Figure 3:
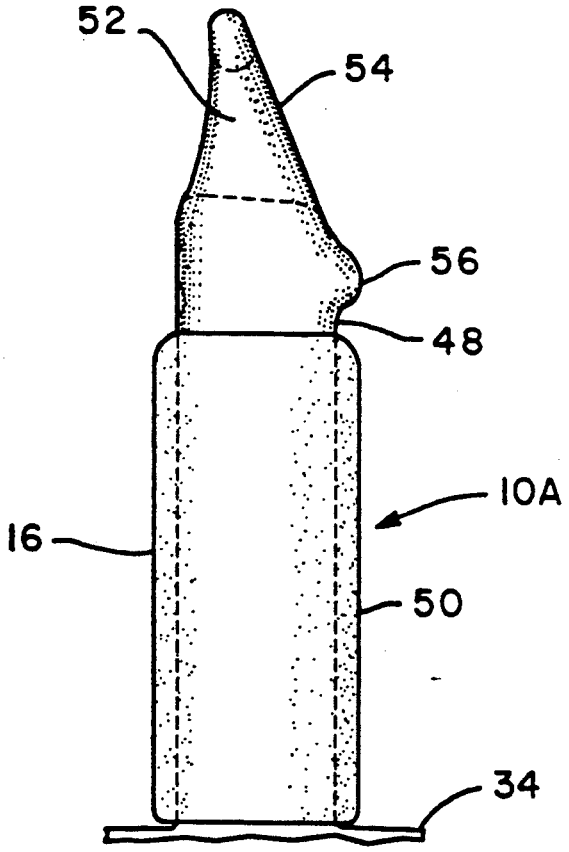
FIG. 3 is a side elevational view of another embodiment of the present invention.

Turning to FIG. 3 it may be observed that a handle structure 10A is depicted with a base member 48 which is surrounded by a soft flexible cover 50. Cover 50 may be composed of a foam plastic. Flange 52 extends from base 48 and includes a ramp surface 54. Flange 52 and base member 48 are formed of a harder and more rigid material than cover 50. Again, implement 30, which may be a stamp, connects to base 48 through frame 34. Protuberance 56 functions in a similar manner to protuberance 42 of handle structure 10 shown in FIGS. 1 and 2.

In operation, the user, in a sitting position, simply grips handle structure 10 as depicted in FIG. 2 such that a plurality of non-thumb fingers 20 contact gripping element 16. Thumb 40, finger I, of hand 22 would lie along ramp surface 38 with the end digit 46 of thumb 40 lying on protuberance 42. It has been found that in a standing position the user tends to wrap thumb 40 around gripping element 16. With reference to handle structure 10A, the non-thumb fingers II–V, squeeze cover 50 when structure 10A is employed with the user in a sitting position. Thumb 40, finger I, extends along ramp surface 54. In both embodiments, the palm of the hand of the user is maintained in a generally vertical position, preventing lateral movement of the palm of the hand during stamping operations. Handle structures may be constructed ab initio with implement 30 or retrofitted to implements such as implement 30. It has determined, that repetitive work such as stamping paper with conventional handle structures can cause medical conditions known as "carpel tunnel syndrome", "trigger finger", as well as "palm tissue deterioration". It is theorized that gripping handle structures as depicted in FIG. 2, and as described with reference to handle structures 10B and 10C, forces a greater use of the elbow and other portions of the arm of the user, rather than use of the wrist 46 and hand 22.

While in foregoing, embodiments of the present invention have been set forth in considerable details for the purposes of making a complete disclosure of the invention, it may be apparent to those of skill in the art that numerous changes may be made in such detail without departing from the spirit and principles of the invention.

What is claimed is:

1. A stamping device for imprinting sheet material with indicia comprising: a frame, a pad having an imprinting surface mounted to and carried by said frame, and a handle secured to said frame for moving said frame and pad into contact with sheet material, said handle comprising a fingers-palm engageable portion and a thumb engageable portion, said fingers-palm engageable portion comprising a rigid cylindrical core secured to said frame on an axis perpendicular to the imprinting surface of the pad and a resilient outer contact member, said thumb engageable portion being flexible and having a thumb contact surface inclined relative to the axis of said cylindrical core; whereby manual engagement of said handle and movement of said pad into contact with sheet material compresses the finger-palm engageable portion and flexes the thumb engageable portion.

2. The stamping device of claim 1, said finger engageable portion having a protuberance formed proximate the fingers-palm engageable portion for engagement with the distal joint of the thumb.

* * * * *